United States Patent [19]

Pyle

[11] 4,090,587

[45] May 23, 1978

[54] LADDER LOCK

[76] Inventor: Edwin G. Pyle, 9213 Ethel St., Cypress, Calif. 90630

[21] Appl. No.: 733,328

[22] Filed: Oct. 18, 1976

[51] Int. Cl.[2] ..... E06C 7/48

[52] U.S. Cl. ..... 182/206

[58] Field of Search ..... 182/206, 93

[56] References Cited

U.S. PATENT DOCUMENTS

| | | | |
|---|---|---|---|
| 2,232,414 | 2/1941 | Swann | 182/206 |
| 3,028,929 | 4/1962 | Chubbs | 182/206 |

FOREIGN PATENT DOCUMENTS

| | | | |
|---|---|---|---|
| 274,211 | 2/1965 | Australia | 182/206 |

*Primary Examiner*—Reinaldo P. Machado
*Attorney, Agent, or Firm*—William C. Babcock

[57] ABSTRACT

A limb attaching lock formed in a manner of a hoop comprising two semicircular segments pivotally attached at one end thereof to a floating center bracket. The semicircular hoop segments are furthermore pivotally supported on a corresponding set of pivotal standoffs attached to a mounting fixture which also connects to two biasing springs for maintaining the hoop segments open. The mounting fixture, in turn, is secured to an attachment brace adapted to engage the end of the ladder. To allow for selective alignment of the limb attaching lock relative the brace and, therefore, accommodate various angles of the limb, the attachment fixture includes a rotatable mount which can furthermore be secured at any desired angle of orientation. A cord connected at one end to the floating bracket extends through openings in the fixture end brace for securing the hoop lock in a closed position.

1 Claim, 5 Drawing Figures

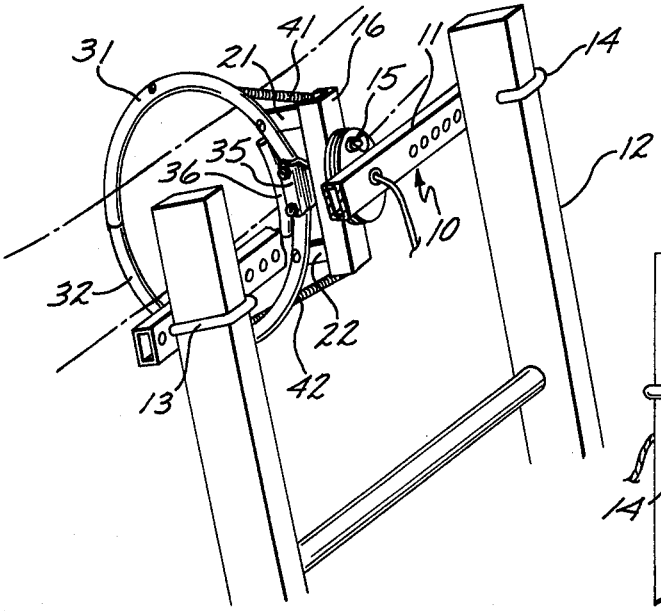
FIG. 1
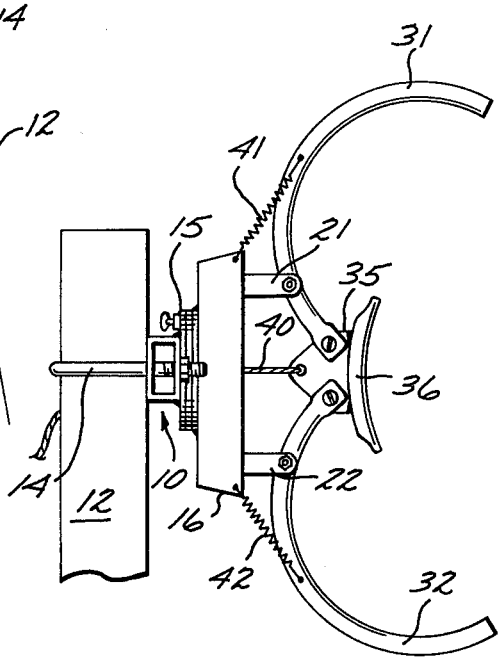
FIG. 2
FIG. 3
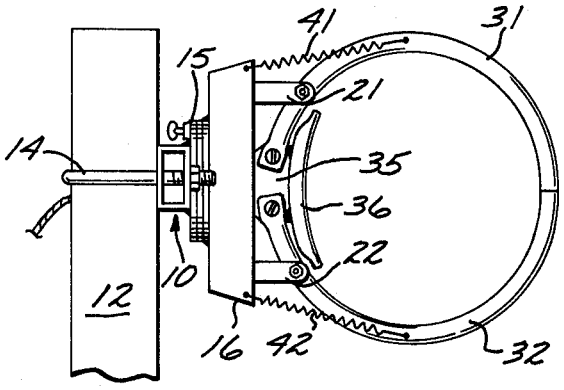
FIG. 4
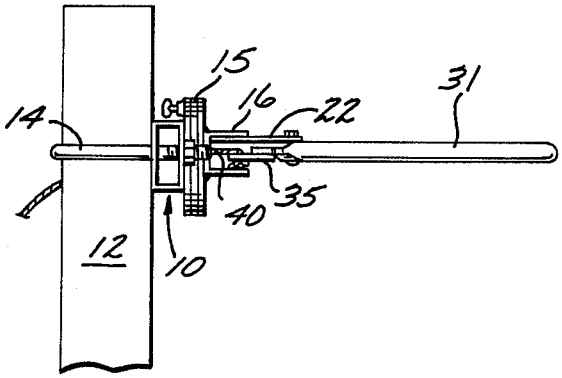
FIG. 5
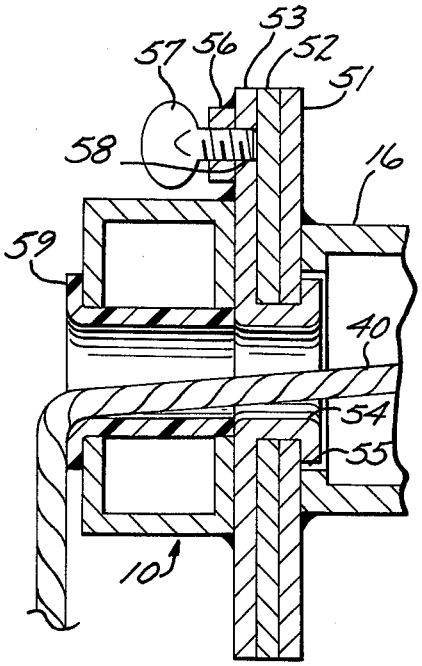

LADDER LOCK

BACKGROUND OF THE INVENTION

1. Field of the Invention

The present invention relates to securing fixtures, and more particularly to locking devices adapted to secure the end of the ladder to a tree limb.

2. Description of the Prior Art

Any labor involved in pruning or cutting back trees frequently entails hazards to the workmen, one of the more prominent hazards being associated with ladders sliding off their supporting limbs. Pruning is most often done on mature and, therefore, tall trees and the tree surgeon must therefore frequently ascend the large heights in order to reach the new growth which is to be thinned or cut back. To provide the necessary reach, most often very long ladders are utilized which on the lower end rest on the frequently uneven ground produced by the root growth and which furthermore on the upper end are supported by limbs very rarely arranged in even geometric orientations.

In the past various devices have been developed for securing the ladder to the supporting limb. Most often such devices have taken the form of a hook or similar configuration, attached to the upper end of the ladder which is then manipulated from the bottom to engage a limb. The large dimensions of the ladder utilizing such hooks or similar fixtures precludes convenient manipulation and the workmen often, in the interest of conserving time, assume the risk of less than perfect engagement.

SUMMARY OF THE INVENTION

Accordingly it is the general purpose and object of the present invention to provide a securing device adapted for attachment to the end of the ladder, the securing device providing both positive engagement to a tree limb or similar supporting structure and a wide opening prior to engagement to facilitate manipulation.

Other objects of the invention are to provide a locking device adapted to surround a tree limb which is normally biased to an open state for convenience in engagement.

Yet further objects of the invention are to provide a ladder securing device which is easy to produce, virtually maintenance free, and convenient in use.

Briefly these and other objects are accomplished within the present invention by providing two semicircular hoop segments pivotally attached at one end thereof to a center bracket for articulation with respect thereto between an open and an encircling alignment. The center bracket furthermore includes a support pad disposed on the interior of the hoop segments which in the course of alignment of a ladder opposes the tree limb. The two semicircular hoop segments are furthermore pivotally supported along the arced segments thereof on two corresponding standoffs extending from a support fixture. A spring extending from each end of the fixture is attached to the corresponding hoop segments to urge the segments to an open position. The fixture, in turn, is rotatably secured to a mounting brace adapted for attachment to the end of the ladder.

Both the mounting fixture and the brace include a common bore through which a cord is passed to engage the center bracket. In this manner the two hooped segments are maintained in an open alignment until contact is made between the pads on the bracket and the selected limb. The weight of the ladder then opposes the spring bias to articulate the hoop segments to a closed position at which time the other end of the cord may be secured to any rung on the ladder, providing a positive lock.

This combination of features utilizes the weight of the ladder to achieve the locking articulation and, therefore, will only achieve closure if the branch or limb selected for ladder support is properly within the lock.

BRIEF DESCRIPTION OF THE DRAWINGS

FIG. 1 is a perspective illustration of an inventive ladder lock articulated to secure a ladder to a limb;

FIG. 2 is a side view of the inventive ladder lock articulated to its normally open state prior to engagement;

FIG. 3 is a side view illustrating the same elements shown in FIG. 2 articulated to a closed position after engagement;

FIG. 4 is yet another side view illustrating an additional degree of freedom of pivotal motion achieved by the present invention; and FIG. 5 is a detailed view, in section, illustrating a rotatable support arrangement useful with the present invention.

DESCRIPTION OF THE SPECIFIC EMBODIMENT

While the following exemplary description makes particular reference to use of the invention herein with tree limbs, such reference is illustrative only. It is to be noted that various other uses may be achieved through minor modifications by one skilled in the art of selected elements of the present invention and no intent to limit the scope thereof is therefore expressed through the choice of the illustration following.

As shown in FIG. 1 a ladder securing device generally designated by the numeral 10 comprises a support brace 11 dimensioned to extend between the two rails of a ladder 12 and selectively secured thereto by two corresponding J-hooks 13 and 14. Mounted substantially central on the support brace 11 and aligned in a plane substantially parallel to the plane of the ladder 12 is a rotatable mount 15 attached on its distal surface to the center segment of a channel iron 16. Attached to the interior of the channel iron or fixture 16 and extending normally therefrom are two pivot standoffs 21 and 22 each pivotally secured at the free end thereof to a corresponding semicircular hoop segments 31 and 32. The point of attachment of standoffs 21 and 22 to the corresponding segments 31 and 32 is along the segment arc to thus dispose the two inwardly opposing ends of the segments in adjacent proximity relative each other. These inwardly opposing ends of segments 31 and 32 are, in turn, pivotally secured to the distal edges of a center bracket 35 which is furthermore secured to an arcuate support pad 36 adapted to oppose a tree limb (not shown) on the interior of the hoop segments.

By reference to FIGS. 2 and 3 the foregoing arrangement of parts establishes a geometrical relationship in which any pivotal motion of hoop segments 31 and 32 must be concurrently accompanied by an angular motion of bracket 35. This is particularly evident when viewed with respect to the radial motion around the pivotal ends of standoffs 21 and 22. More specifically the interior ends of segments 31 and 32, during their pivotal motion, will establish two arcs of fixed radii, the separation therebetween varying along the path of inward progression of bracket 35. Since the relative dimensions between the two standoffs are fixed and the radial dimensions of the two interior ends of segments 31 and 32 are similarly fixed, and inward or outward motion of bracket 35 can only be achieved if the bracket is concurrently rotated to accommodate the varying distance between the adjacent ends of the segments. During the initial alignment of the ladder relative the limb small manual corrections will insure sufficient eccentric loading on pads 36 to accommodate this inward motion. Once the inventive lock assembly achieves a closed state, illustrated in FIG. 3, the arcuate configuration of pad 36, under the load of an occupied ladder will seek a centered alignment on the limb to thus prevent unlatching. Accordingly, under normally aligned loading the hoop segments 31 and 32 will either achieve an open or a closed state. Once brought to a closed state this inventive configuration can then be conveniently maintained secure by way of a rope or cord 40 extending centrally from bracket 35 through mount 15 and brace 11 which may be secured to any rung of the ladder (not shown). To facilitate biasing to an open state the inventive lock 10 further includes two springs 41 and 42 respectively attached between the ends of fixture 16 and the corresponding segments 31 and 32. The point of attachment of springs 41 and 42 to the corresponding segments is exterior of the pivots thereof to thus urge the segments to an open state.

By reference to FIGS. 1, 4 and 5 the inventive lock assembly 10 furthermore includes provisions for selective alignment of the plane of motion of segments 31 and 32 to achieve the above described locking engagement around limbs extending at various angles relative the horizontal. Specifically as shown in FIG. 4 one of the orientations achievable by virtue of the structure to be described is a horizontal orientation by which a vertical limb may be encircled. Thus FIG. 4 when contrasted with the alignment shown in FIGS. 2 and 3 illustrates the range of angular alignment achievable herein. This angular alignment is achieved by virtue of the structure of mount 15 shown in detail in FIG. 5. More specifically mount 15 comprises an annular disc 51 attached on one face thereof to the center segment of fixture 16. As spacer 52 having dimensions substantially similar to disc 51 opposes the other side of the disc 51. Yet another disc 53 on the other side of spacer 52 extends from a central tube 54 which terminates in a circular lip 55 to surround the annular disc 51 and therefore the spacer 52. It is this disc 53 that is, in turn, attached to the brace 12 and therefore provides the attaching structure. Formed on the exterior of disc 53 is a nut assembly 56 which threadably engages a thumb screw 57 passing through an opening 58 in disc 53 to oppose the spacer 52 and thus secure the angular alignment of mount 15.

Brace 11 furthermore includes a tubular liner 59 aligned axially with tube 54 to provide a guide way for the rope or cord 40 from the interior of fixture 16 across the mount and brace. It is this cooperative arrangement of the various components disclosed herein that provide the convenience in engagement set forth above.

Obviously many modifications and variations to the above disclosure can be made without departing from the spirit of the invention. It is therefore intended that the scope of the invention be determined solely on the claims appended hereto.

I claim:

1. A locking device for use in securing the upper end of a ladder to an object comprising:

a mounting structure adapted for selective engagement to said ladder;

a support fixture secured for rotation to said structure, including means for selective angular attachment thereof relative said structure;

a first and second pivotal mount respectively attached to the ends of said fixture;

a first and second arcuate element respectively secured for substantially coplanar pivotal motion to said first and second pivotal mounts;

a joining bracket pivotally secured at the ends thereof to the proximate ends of said first and second elements;

securing means connected to said bracket for engagement thereof in a predetermined alignment relative said fixture;

an arcuate support pad connected to said bracket and disposed to extend on the interior of said elements in overlapping arrangement relative the proximate ends thereof;

said bracket comprises a substantially triangular segment pivotally joined at two corners thereof to said proximate ends of said first and second elements; and said securing means comprises a flexible cord secured at one end to the third corner of said segment and disposed to selectively secure said segment relative said fixture.

* * * * *